US011519205B2

(12) United States Patent
Woo

(10) Patent No.: US 11,519,205 B2
(45) Date of Patent: Dec. 6, 2022

(54) CLOSURE LATCH ASSEMBLY WITH POWER LOCK MECHANISM HAVING OUTSIDE LOCK LEVER WATER PROTECTION

(71) Applicant: MAGNA CLOSURES INC., Newmarket (CA)

(72) Inventor: Kar Wang Woo, Markham (CA)

(73) Assignee: MAGNA CLOSURES INC., Newmarket (CA)

( * ) Notice: Subject to any disclaimer, the term of this patent is extended or adjusted under 35 U.S.C. 154(b) by 628 days.

(21) Appl. No.: 16/407,633

(22) Filed: May 9, 2019

(65) Prior Publication Data

US 2019/0345746 A1 Nov. 14, 2019

Related U.S. Application Data

(60) Provisional application No. 62/721,252, filed on Aug. 22, 2018, provisional application No. 62/672,431, filed on May 16, 2018, provisional application No. 62/670,961, filed on May 14, 2018.

(51) Int. Cl.
*E05B 85/20* (2014.01)
*E05B 83/36* (2014.01)

(52) U.S. Cl.
CPC ..... *E05B 85/20* (2013.01); *E05B 83/36* (2013.01)

(58) Field of Classification Search
CPC ..... E05B 85/02; E05B 77/34; E05B 81/16; E05B 81/14; E05B 17/002; E05B 2015/1664; E05B 9/00; E05B 15/1635; E05B 85/20; E05B 83/36; Y10T 292/1047; Y10T 292/48; Y10T 292/51; Y10T 292/62; E05C 19/12
See application file for complete search history.

(56) References Cited

U.S. PATENT DOCUMENTS 3,033,046 A * 5/1962 Rodda ..... F16J 15/52 74/18.1
4,452,058 A * 6/1984 Noel ..... E05B 81/06 292/201
5,060,864 A * 10/1991 Nishi ..... B05B 12/02 239/289

(Continued)

FOREIGN PATENT DOCUMENTS

CN 101358506 A 2/2009
CN 103510770 A 1/2014

(Continued)

OTHER PUBLICATIONS

Chinese Office Action and Search Report from the Chinese Patent Office for related Chinese Application No. 201910399606.X, dated Sep. 23, 2021, 11 page(s), English Translation Included.

*Primary Examiner* — Mark A Williams
(74) *Attorney, Agent, or Firm* — Dickinson Wright PLLC

(57) ABSTRACT

A vehicle closure panel latch assembly having pivotable actuator lever sealed against the ingress of water into a housing of the latch assembly is provided. The actuator lever is configured for receipt in an opening of the housing and for operable connection to an internal latch component. A seal member is disposed about a portion of the actuator lever to form a water-tight seal between the housing and the actuator lever to prevent the passage of water through the opening.

18 Claims, 16 Drawing Sheets

(56) References Cited

U.S. PATENT DOCUMENTS

| | | | | |
|---|---|---|---|---|
| 5,079,873 | A * | 1/1992 | Smith | E06B 7/2318 49/477.1 |
| 5,642,806 | A * | 7/1997 | Karadimas | H01H 23/065 200/302.3 |
| 5,855,130 | A * | 1/1999 | Rorabacher | E05B 81/25 292/201 |
| 5,967,571 | A * | 10/1999 | Gregerson | E05B 51/02 292/138 |
| 6,076,882 | A * | 6/2000 | Szerdahelyi | B60J 5/0416 280/730.2 |
| 8,870,247 | B2 * | 10/2014 | Yamagata | E05B 85/02 292/216 |
| 9,957,736 | B2 | 5/2018 | Taurasi et al. | |
| 2005/0046230 | A1 * | 3/2005 | Fukumoto | B60J 5/0416 296/155 |
| 2010/0140964 | A1 * | 6/2010 | Schmidt | H02G 3/081 292/347 |
| 2014/0084599 | A1 * | 3/2014 | Beck | E05B 83/34 292/58 |
| 2014/0352223 | A1 * | 12/2014 | Le | E05C 3/048 49/344 |
| 2014/0361555 | A1 * | 12/2014 | Bendel | E05B 85/00 292/307 R |
| 2018/0010370 | A1 | 1/2018 | Ishiguro et al. | |
| 2019/0017298 | A1 | 1/2019 | Sardelli et al. | |
| 2019/0136590 | A1 | 5/2019 | Patane et al. | |

FOREIGN PATENT DOCUMENTS

| | | | |
|---|---|---|---|
| CN | 203476007 | U | 3/2014 |
| CN | 206625692 | U | 11/2017 |
| GB | 2240583 | A | 8/1991 |

* cited by examiner

CLOSURE LATCH ASSEMBLY WITH POWER LOCK MECHANISM HAVING OUTSIDE LOCK LEVER WATER PROTECTION

CROSS-REFERENCE TO RELATED APPLICATIONS

This application claims the benefit of U.S. Provisional Application Ser. No. 62/721,252, filed Aug. 22, 2018, U.S. Provisional Application Ser. No. 62/672,431, filed May 16, 2018, and U.S. Provisional Application Ser. No. 62/670,961, filed May 14, 2018, which are each incorporated herein by reference in their entirety.

FIELD

The present disclosure relates generally to latch assemblies of vehicle closure panels, and more particularly to latch assemblies having lock levers with seal members to inhibit water ingress.

BACKGROUND

This section provides background information related to the present disclosure that is not necessarily prior art.

Vehicle doors are typically equipped with a latch assembly configured to allow selective opening and closing of the door. Latch assemblies commonly have multiple components assembled to one another, such as a housing and cover having peripheries brought into mating abutment with one another, as well as a multiple functional internal components contained within the housing/cover assembly. Further, openings are typically formed in the housing and/or cover to allow for the through passage of one or more members, such as an actuator lever(s), e.g. outside lock lever, for operable connection to one or more of the functional internal components.

Problems can arise if water is permitted to enter the latch assembly. For example, the ingress of water can cause corrosion, and if allowed to freeze, can damage and/or jam internal components, thereby preventing internal components from functioning as intended. Unfortunately, seams and/or gaps, through which water can penetrate, are established where an actuator lever(s) passes through the housing and/or cover, and thus, potential damage and jamming may occur as a result thereof. The aforementioned problem can be particularly troublesome for latch assembly arrangements having openings in an upper surface (facing upwardly relative to a ground surface) for the passage of an actuator lever(s), as gravity ultimately promotes the ingress of water therethrough. For example, latch assemblies configured for actuation via bowden cables often have openings in the housing and/or cover to allow the bowden cables to extend into the latch to interact with the internal components. Although needed, these openings can present an entry point for water ingress, i.e. from water which may flow along the surface of the bowden cable into the latch assembly, or from water which may be on the surface of the latch assembly adjacent to such openings and creep, for example under the force of gravity, into the latch assembly.

In view of the above, there is a need to provide a latch assembly that can include one or more openings through a housing/cover assembly thereof for the passage of cables and/or levers therethrough, while at the same time avoiding ingress of water into the housing/cover assembly in an economical, reliable and assembler friendly manner so as to avoid compromising the ability of the latch assembly to function optimally for a long and useful life, as desired.

SUMMARY

This section provides a general summary of the disclosure and is not intended to be considered a complete and comprehensive listing of the disclosure's full scope or all of its aspects, advantages, objectives and/or features.

It is an object of the present disclosure to provide a sealed latch assembly that inhibits the ingress of water into an internal cavity containing latch components, thereby preventing jamming due to freezing and inhibiting the onset of corrosion.

It is a further object of the present disclosure to provide a latch assembly having one or more seal members to inhibit the ingress of water between an opening(s) in the housing and/or cover and an actuator lever(s) passing therethrough.

It is a further object of the present disclosure to provide a sealed latch assembly that is economical in manufacture and assembly and that exhibits a long and useful life.

In accordance with these objectives, as well as others, which will be appreciated by those possessing ordinary skill in the art of latches, the present disclosure is directed to providing a sealed latch assembly for a vehicle closure panel. The sealed latch assembly includes a housing having an internal cavity sized for receipt of internal latch components of the latch assembly and a cover attached to the housing to enclose at least a portion of the internal cavity. The housing and/or cover present an opening configured for the passage of an actuator lever therethrough for operable connection to at least one of the internal components to effect actuation of the internal component. Further, a seal is configured for receipt about a portion of the actuator lever to form a water-tight seal between the housing and/or cover and the actuator lever to prevent the passage of water through the opening.

In accordance with these objectives, as well as others, which will be appreciated by those possessing ordinary skill in the art of latches, the present disclosure is directed to providing a vehicle closure panel having the sealed latch assembly, the sealed latch assembly includes a housing having an internal cavity sized for receipt of internal latch components of the latch assembly and a cover attached to the housing to enclose at least a portion of the internal cavity. The housing and/or cover present an opening configured for the passage of an actuator lever therethrough for operable connection to at least one of the internal components to effect actuation of the internal component. Further, a seal is configured for receipt about a portion of the actuator lever to form a water-tight seal between the housing and/or cover and the actuator lever to prevent the passage of water through the opening.

In accordance with a further aspect of the disclosure, the seal member can be fixed against relative movement with the actuator lever, thereby enhancing the ability to maintain a water-tight seal therebetween and minimizing wear of the seal member.

In accordance with a further aspect of the disclosure, the seal member can be bonded with the actuator lever, thereby preventing unwanted movement or separation between the seal member and the actuator lever.

In accordance with a further aspect of the disclosure, the seal member and the actuator lever can be configured to pivot relative to the housing in a water-tight seal therewith and in low frictional engagement therewith.

In accordance with a further aspect of the disclosure, the actuator lever can be provided having a first member disposed external to the internal cavity and a second member disposed within the internal cavity, with the first member and the second member being constructed of separate pieces of material, and the first member being fixed against relative movement with the second member.

In accordance with a further aspect of the disclosure, the first member can be provided having one of a non-circular male protrusion and a non-circular female pocket and the second member can be provided having the other of the non-circular male protrusion and the non-circular female pocket, with the non-circular male protrusion being configured for mating receipt in the non-circular female pocket to prevent relative rotation between the first member and the second member, thereby preventing slop (play) between the first and second members.

In accordance with a further aspect of the disclosure, the seal member can be bonded to the first member, such as in a molding process, thereby making assembly of the subassembly, including the seal member and first member, to the housing and the second member easy and economical.

In accordance with a further aspect of the disclosure, the seal member can be provided having an annular seal lip brought into seal engagement with the outer surface for relative low friction, pivotal movement thereagainst, thereby enhancing the water-tightness of the seal perfected.

In accordance with a further aspect of the disclosure, the seal member can be provided having a bellowed projection with a through passage extending therethrough, wherein the actuator lever extends through the through passage in sealed relation therein, with the bellowed projection facilitating pivoting movement of the actuator lever.

In accordance with a further aspect of the disclosure, the housing can be provided having a fastener opening and the seal member can have a fastener member formed as a monolithic piece of material therewith, with the fastener member being disposed through the fastener opening for fixation therein.

In accordance with a further aspect of the disclosure, the seal member can be formed having a base wall from which the bellowed projection extends and a seal lip can be provided to extend along at least a portion of the base wall for sealed engagement with an outer surface of the housing.

In accordance with a further aspect of the disclosure, the actuator lever can be provided to function as an outside lock lever.

In accordance with a further aspect of the disclosure, a method of preventing ingress of water into an internal cavity of a latch assembly of a vehicle closure panel between an actuator lever and an opening in a housing of the latch assembly includes disposing a portion of the actuator lever through the opening for operable connection with an internal latch component and, disposing a seal member about a portion of the actuator lever to form a water-tight seal between the housing and the actuator lever to prevent the passage of water through the opening.

In accordance with a further aspect of the disclosure, the method can further include providing the actuator lever having a first member and a second member constructed of separate pieces of material and disposing the first member external to the internal cavity and the second member within the internal cavity and fixing the first member against relative movement with the second member.

In accordance with a further aspect of the disclosure, the method can further include bonding the seal member to the first member and providing the seal member having an annular seal lip brought into sealed engagement with an outer surface of the housing for relative sealed, pivotal movement thereagainst.

In accordance with a further aspect of the disclosure, the method can further include providing the seal member having a bellowed projection with a through passage extending therethrough and extending the actuator lever in sealed relation through the through passage.

In accordance with a further aspect of the disclosure, the method can further include providing the housing having a fastener opening and providing the seal member having a fastener member and fixing the fastener member within the fastener opening.

Further areas of applicability will become apparent from the detailed description provided herein. The description and specific examples provided in this summary are intended for purposes of illustration only and are not intended to limit the scope of the present disclosure.

BRIEF DESCRIPTION OF THE DRAWINGS

Other aspects and advantages of the present non-limiting embodiments will be readily appreciated, as the same becomes better understood by reference to the following detailed description and appended claims when considered in connection with the accompanying drawings, wherein:

Corresponding reference numerals indicate corresponding components throughout the several views of the drawings, unless otherwise indicated.

DETAILED DESCRIPTION OF THE EXAMPLE EMBODIMENTS

Figure 1:
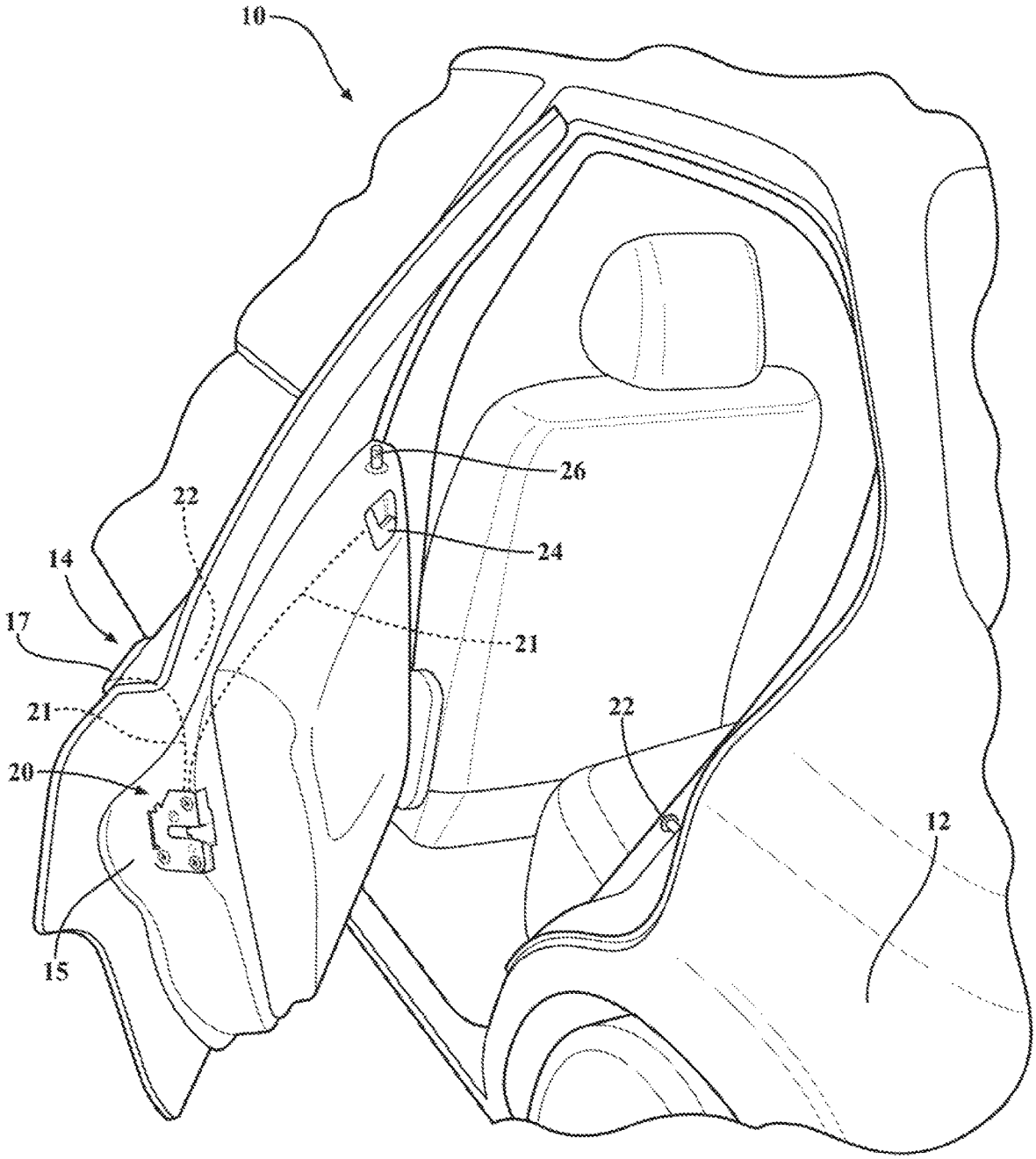
FIG. 1 is a partial perspective view of a motor vehicle equipped with a pivotal passenger-entry door having a door handle operably interconnected to a latch assembly constructed in accordance with and embodying the teachings of the present disclosure.

In general, example embodiments of latch assemblies of the type configured for use with motor vehicle closure systems, constructed in accordance with the teachings of the present disclosure, will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," "operably connected to" or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Figure 3:
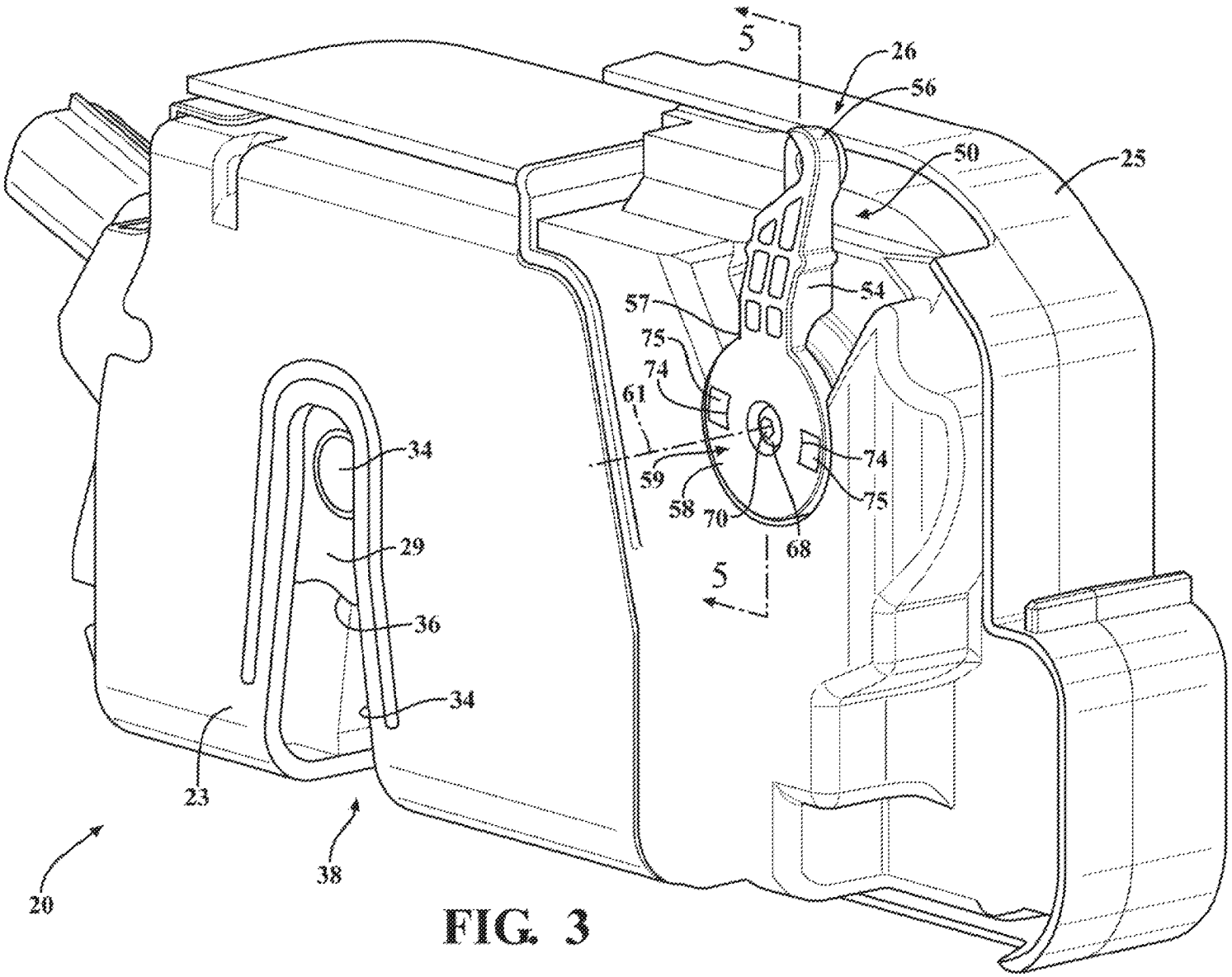
FIG. 3 is a perspective view of the latch assembly of FIG. 2 illustrating an outside lock lever thereof in accordance with one aspect of the disclosure.
Figure 4:
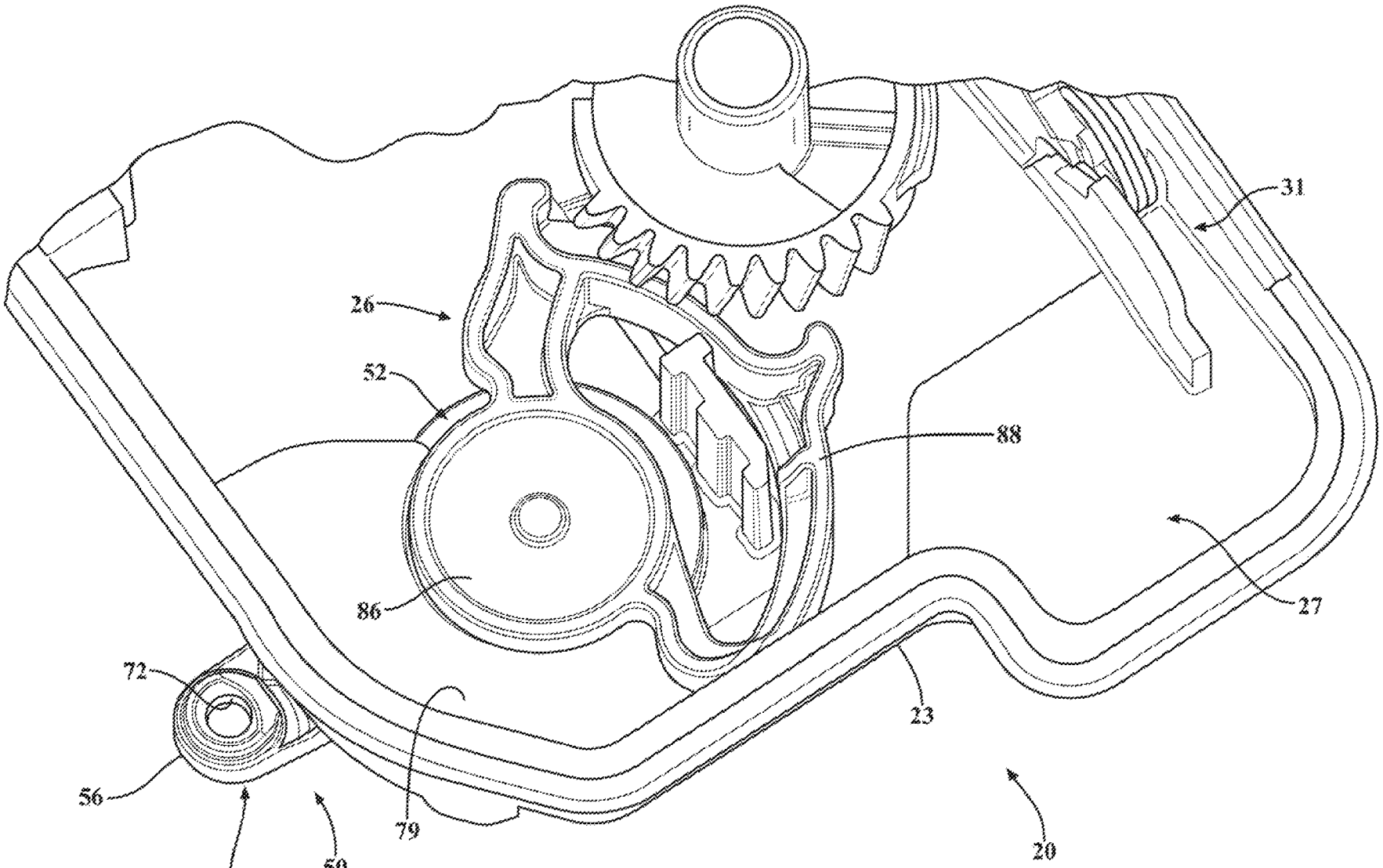
FIG. 4 is an enlarged plan view showing a portion of the latch of FIG. 2 with a motor removed to better illustrate the outside lock lever.

FIG. 1 is a perspective view of a vehicle 10 that includes a vehicle body 12 and at least one vehicle closure panel, shown as a vehicle door 14, by way of example and without limitation. The vehicle door 14 includes an edge face 15, inside and outside door handles 16, 17, a lock knob 18, with a hinge(s) (not shown) pivotally fixing the door 14 to the vehicle body 12. A latch assembly, also referred to simply as latch 20, is positioned or sealing affixed against an inner surface the edge face 15. The latch 20 includes a housing 23 and a cover 25 bounding a cavity 27 in which internal latch components 31 are contained, including a latch mechanism release component including a pivotal latch member (i.e. ratchet 29, FIG. 3) that is releasably engageable with a striker 22 mounted on the vehicle body 12 to releasably hold the vehicle door 14 in a closed position, as is known. The lock knob 18 (optional) is shown and provides a visual indication of the lock state of the latch 20 and may be operable to change the lock state between an unlocked state and a locked state. At least one of the handles 16, 17 is operably connected to the latch 20 via a wire or release cable 21, such as a Bowden cable, by way of example and without limitation, for facilitating actuation of latch assembly 20 via intended (selective) operation of the handles 16, 17. Specifically, the release cable 21 operably connects one or both of handles 16, 17 to the functionally moveable latch member release component of the latch assembly 20 for opening or unlatching the latch assembly 20 (i.e. for releasing striker 22 from latched engagement with the ratchet 29 to open the vehicle door 14). Further, with reference to the outside door handle 17, by way of example and without limitation, a lock/unlock control knob of handle 17, i.e. key cylinder 24, can be configured for operable coupling with an actuation lever, such as a lock lever 26, e.g. an outside lock lever of latch 20, via a cable or rod 28. The latch 20, and in particular the region of the housing 23, by way of example and without limitation, having an opening 30 through which the lock lever 26 extends is constructed and otherwise configured to inhibit the ingress of water therein. As such, the potential for jamming of functional internal components 31 due to freezing is prevented, while further inhibiting the onset of corrosion of functional internal components 31. To facilitate the inhibition of water ingress through the opening 30 and into the cavity 27 containing internal latch components, the latch 20 includes a seal member 32 disposed about a portion of the lock lever 26 to form a water-tight seal between the housing 23 and the lock lever 26, thereby preventing the passage of water through the opening 30 between the lock lever 26 and opening 30. Accordingly, the latch assembly 20 is able to function as intended, for an extended useful life, without concern of malfunction resulting from phenomenon related to the ingress of water.

Figure 2:
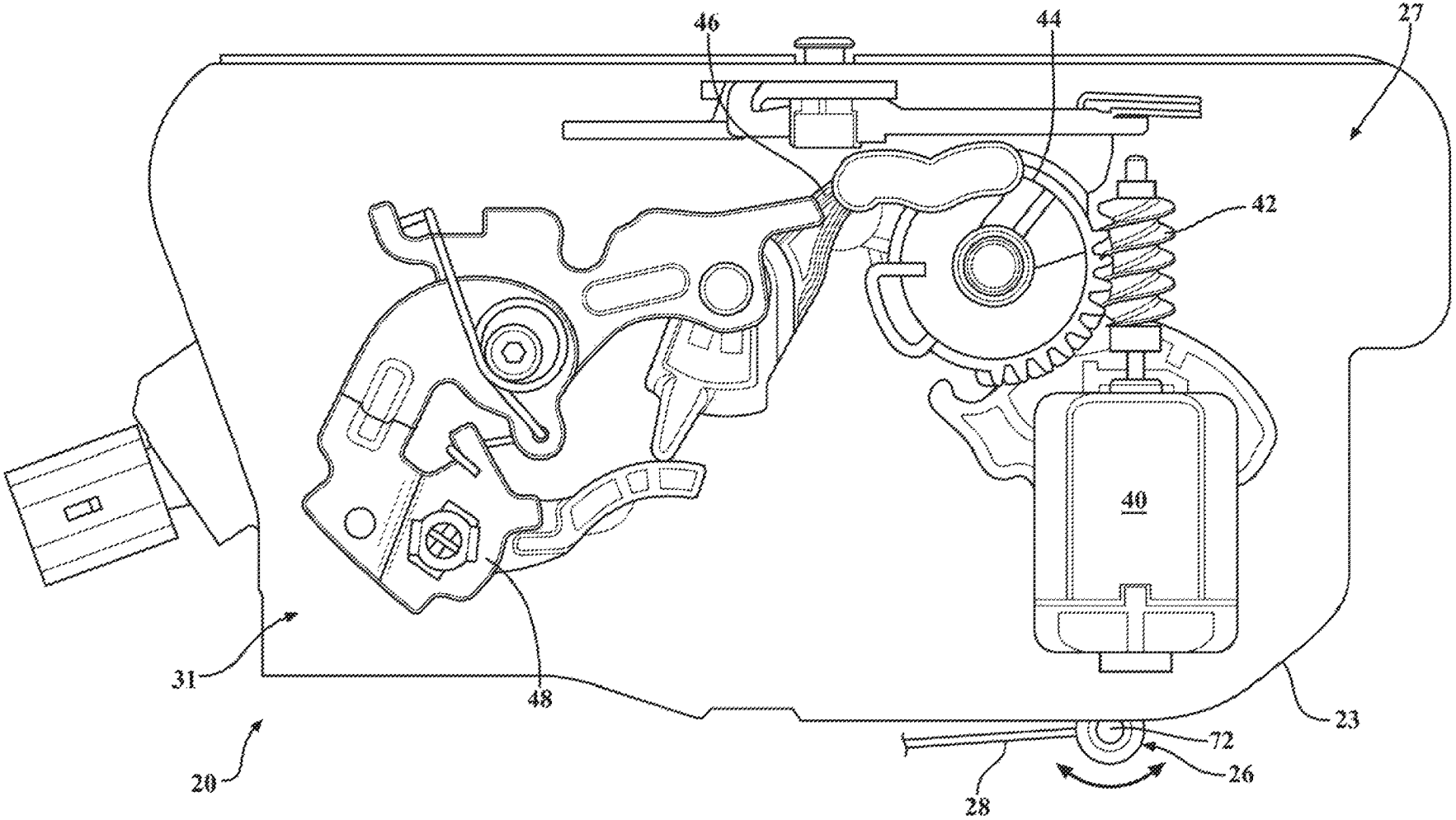
FIG. 2 is a plan view of a latch, such shown in FIG. 1, with a cover removed therefrom to illustrate some internal components thereof.

With regard to the latch 20, FIG. 2 is a plan view showing some of the functional internal latch components 31 of one possible embodiment of latch 20 in accordance with the disclosure, with some of the internal components 31, such as the ratchet 29 (FIG. 3), one or more pawls, one or more link levers, and spring members, being hidden beneath the viewable internal latch components 31, while those possessing ordinary skill in the art of vehicle latches will readily appreciate other latch arrangements. As is known in the vehicle latch art, the ratchet 29 can be pivotally mounted for pivoting movement between a fully closed position, whereat the striker 22 is captured in a slot 34 of ratchet 29 formed in part by a hook 36 of the ratchet 29, thereby being maintained in a fishmouth 38 of housing 23, and an open position, whereat the striker 22 is not trapped and maintained within the fishmouth 38 by the hook 36 and is free to move out of the slot 34 presented by the ratchet 29. In the view shown in FIG. 3 the ratchet 29 rotates clockwise to move from the closed position to the open position.

The internal components 31 readily seen in FIG. 2, include, among others, a motor 40 selectively operable to drive a worm gear 42, which in turn drives a lock/unlock gear 44, thereby pivoting a lock link lever 46 into and out of selective operable engagement with an outside release lever 48, which is operably coupled to outside door handle 17 via cable 21. Lock link lever 46 is selectively moveable between locked and unlocked positions via motor 40 and via pivoting movement of outside lock lever 26, in response to selective actuation of key lock cylinder 24, as desired. When lock link lever 46 is pivoted out of operable engagement with outside release lever 48, outside release lever 48 is rendered inoperable in that actuation thereof will not cause latch 20 to move from its latched state to its unlatched state. Contrarily, when lock link lever 46 is pivoted into operable engagement with outside release lever 48, outside release lever 48 is rendered operable in that actuation thereof will cause latch 20 to move from its latched state to its unlatched state.

The housing 23, cover 25 and outside latch lever 26 of latch 20 may be manufactured of a plastic material formed by a plastic injection molding process, by way of example and without limitation, but may also be formed from, or in combination with, for example, a metal material, a carbon fiber material, or other materials of suitable durability and strength.

Figure 8:
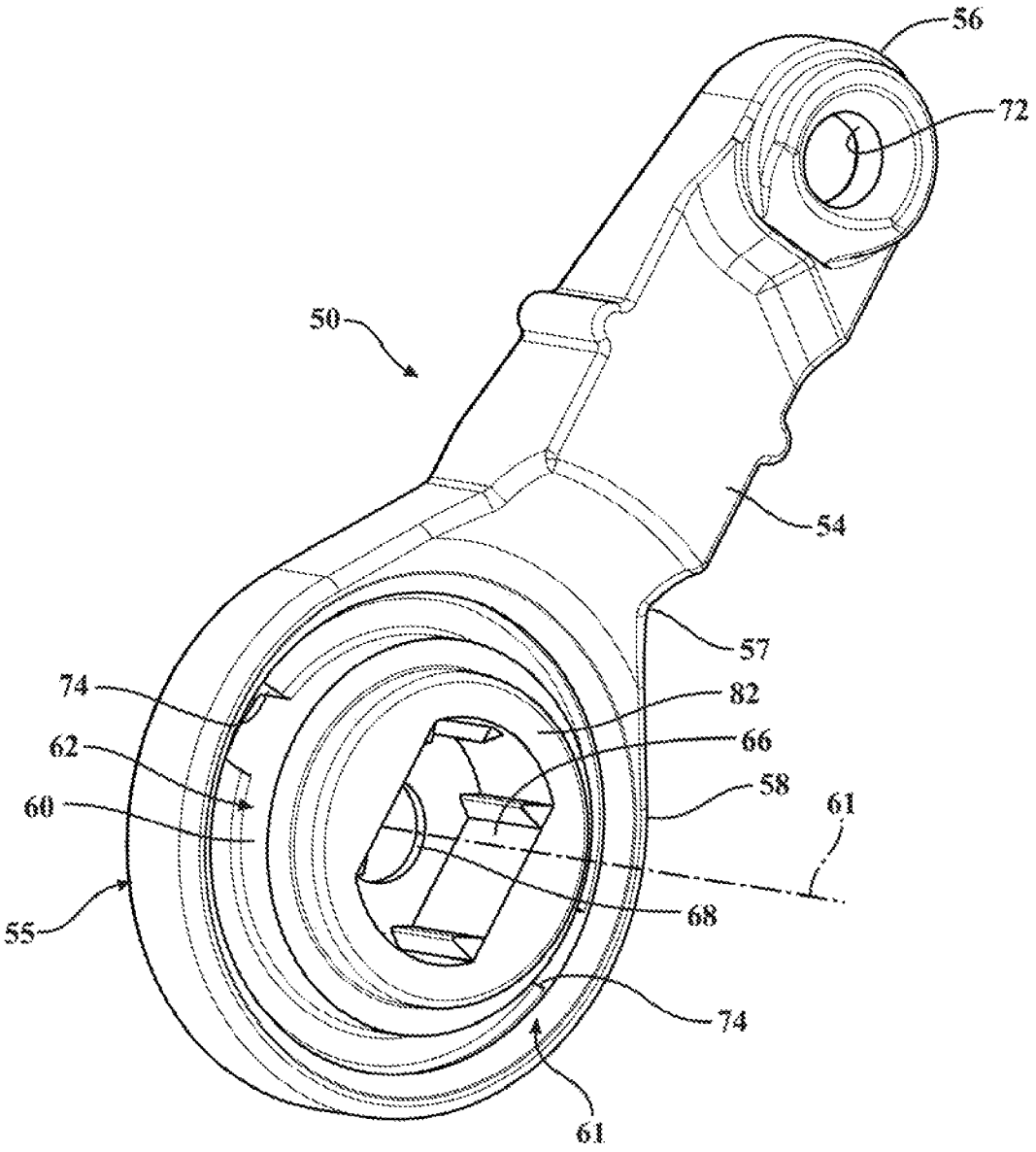
FIG. 8 is a bottom perspective view of a first portion of the outside lock lever of FIG. 6 shown prior to fixing a seal member thereto.

The outside lock lever 26 has a first member 50 disposed externally to the internal cavity 27, shown as extending generally parallel along an outer surface of the housing 23, and a separate second member 52, formed from a separate piece of material from the first member 50, disposed internally within the internal cavity 27. The first member 50, as best illustrated in FIG. 8, has an elongate arm portion 54, also referred to as arm, extending lengthwise between opposite ends 56, 57 and a generally planar disc portion 58 extending from end 57 of arm 54. Disc portion 58 is shown as having a circular or generally circular (meaning the outer periphery may not have a constant radius, but could be otherwise shaped having a varying radius) outer periphery 55, by way of example and without limitation, bounding top and bottom surfaces 59, 61. An annular hub, also referred to as boss 60, extends transversely from the bottom surface 61 of disc portion 58 about a pivot axis 67. The boss 60 has a generally cylindrical outer surface 62 (FIG. 8) sized for close receipt through opening, such that negligible or no perceivable slop or play can be felt between boss 60 and opening 30. Boss 60 has a hollowed inner bore 64 extending to bottom surface 61, wherein the bore 64 can be formed having a non-circular portion, shown as being formed as a generally rectangular, female pocket 66, by way of example and without limitation, wherein the non-circular portion 66 acts as a non-rotation feature to prevent relative rotation between the first and second members 50, 52, discussed further below. A through opening 68 extends along the pivot axis 67, through the top and bottom surfaces 59, 61 of disc portion 58, into the bore 64 for receipt of a fastener 70 therethrough, such as a threaded screw, by way of example and without limitation. The fastener 70 is configured to fix the first member 50 against relative movement to the second member 52. An attachment feature, such as an opening 72, is provided immediately adjacent the end 56 of arm portion 54 for attachment of rod 28 (FIG. 2) thereto. Further, to facilitate fixation of the seal member 32 to the first member 50, a retention feature 74 is formed on disc portion 58, such as in the bottom surface 61, with the retention feature being shown, by way of example and without limitation, as a pair of generally L-shaped through openings 74 extending through the top and bottom surfaces 59, 61. The retention features 74 are shown as being located on diametrically opposite sides of the disc portion 59, though it is contemplated that they could be located in any suitable location and arrangement. As discussed further below, a portion of the seal member 32 is configured for fixed receipt within the retention features 74 to enhance fixation of seal member 32 about boss 60.

Figure 5:
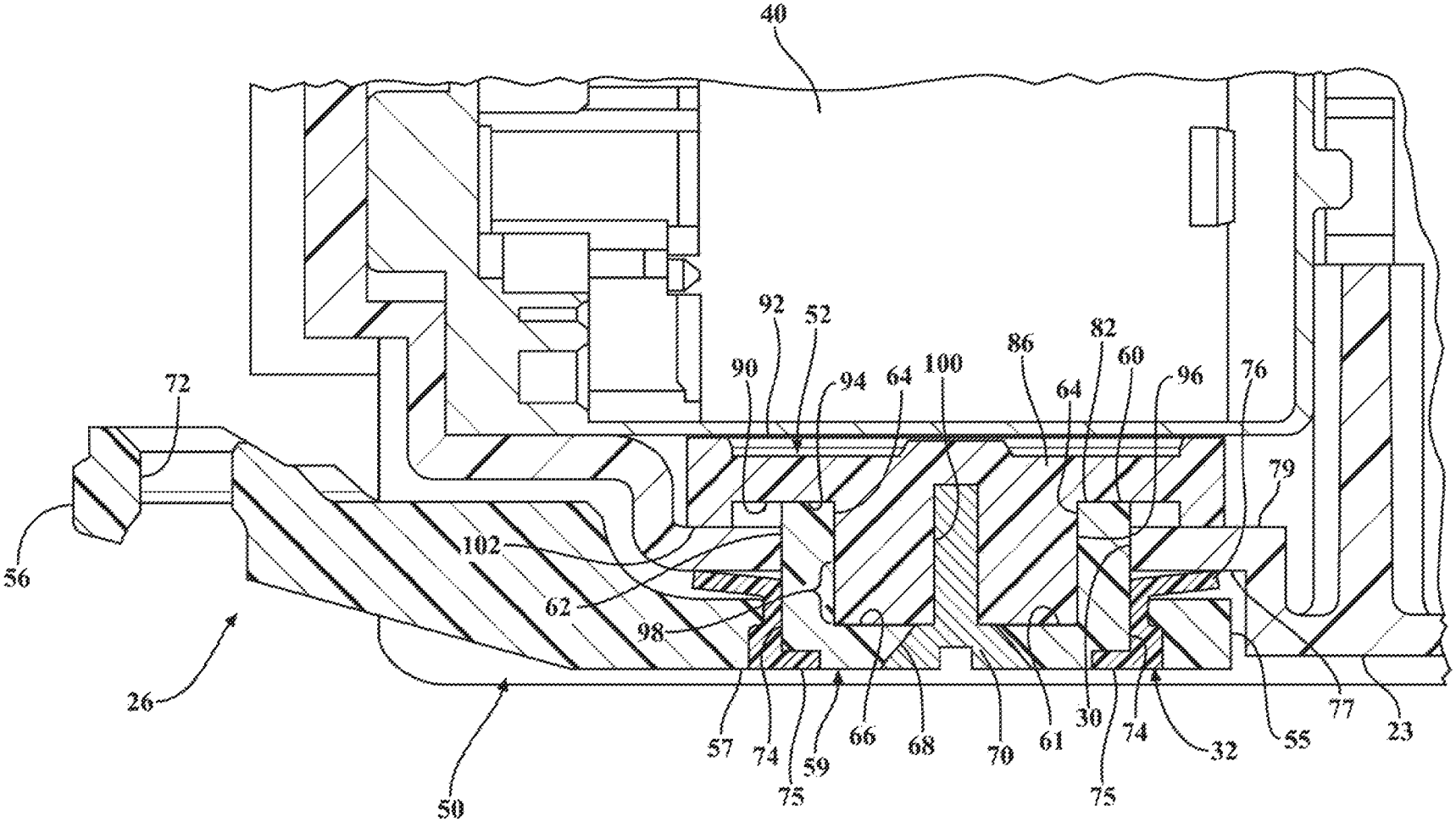
FIG. 5 is cross-sectional view taken generally along the line 5-5 of FIG. 3.
Figure 9:
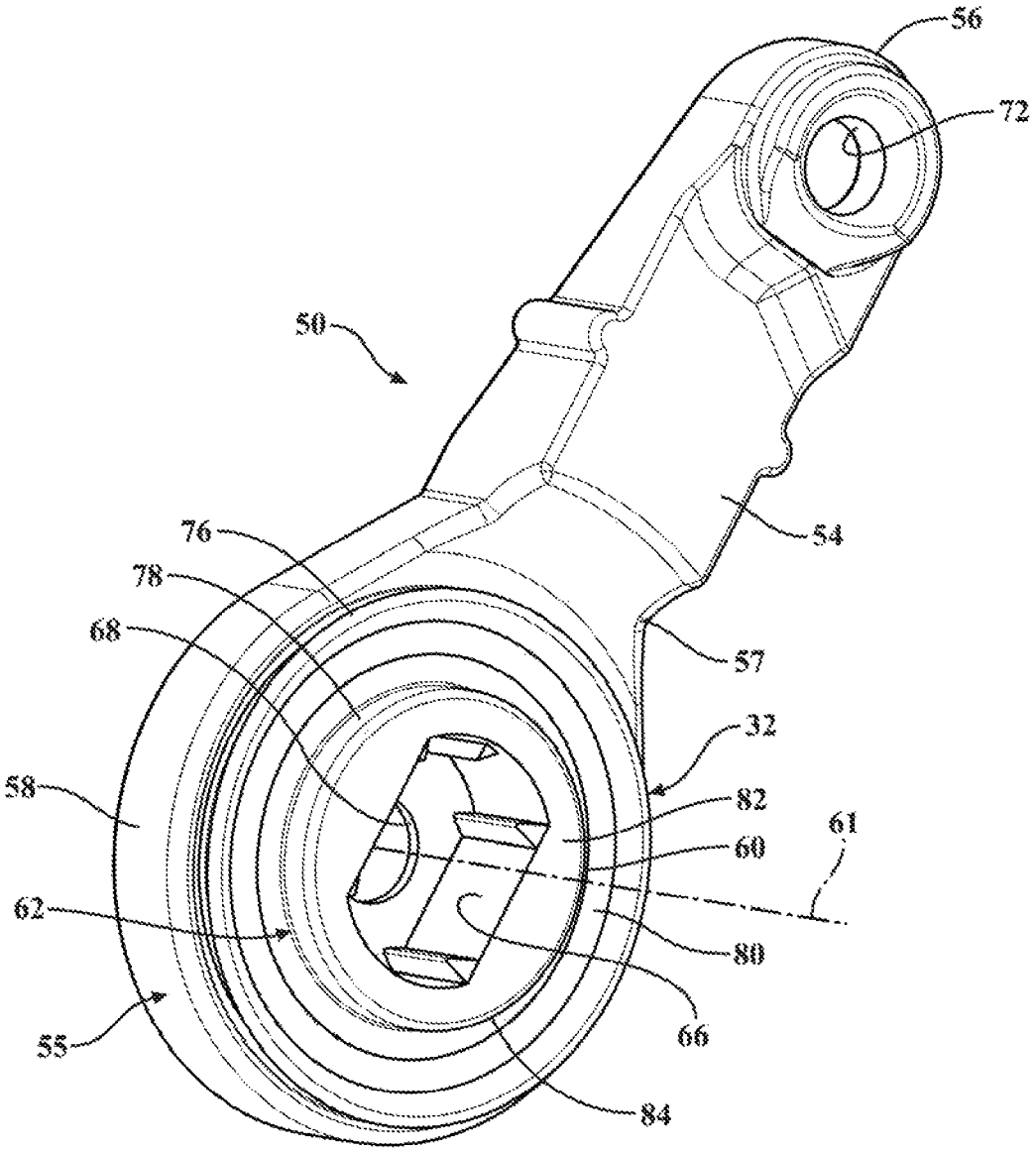
FIG. 9 is a view similar to FIG. 8 shown after fixing a seal member thereto.
Figure 9A:
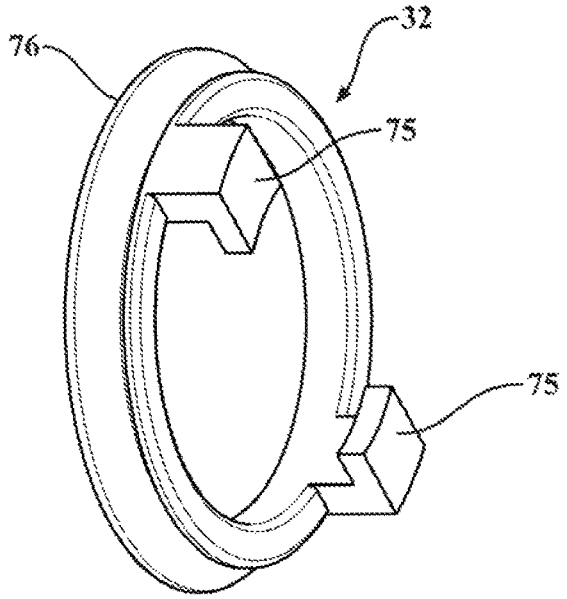
FIG. 9A is a perspective view of the seal member of FIG. 9.

Seal member 32 is formed of any desired elastomeric seal material, such as from various types of rubber, including, by way of example and without limitation, Nitrile or silicone-based polymers. The seal member 32 can be molded to the second member 52 about the boss 60 in an over-molding process, such as in an injection over-molding process, by way of example and without limitation, thereby allowing the seal material to flow into the L-shaped retention features 74 to form conform L-shaped ears 75 for secure bonding and fixation therein. FIG. 9A shows the as over-molded configuration of seal member 32 with the first member 50 removed for clarity, though it is to be recognized that the seal member 32 could be formed in advance of being fixed to the first member 50 to have the configuration shown in FIG. 9A, and then the seal member 32 could be subsequently fixed to the first member 50, such as via a suitable adhesive, welding, or the like. Of course, aside from the ears 75 being fixed and bonded in the retention features 74, the seal material can bond about the outer surface 62 of boss 60. Seal member 32 can be formed having any desired shape and contoured features to facilitate the formation of a reliable seal to prevent the ingress of water through opening 30. Seal member 32 is best shown in FIGS. 5, 9 and 9A as including a resilient annular seal lip 76 diverging radially outwardly and away from ears 75 for sealed abutment with an outer surface 77 of housing 23 about and adjacent opening 30. Accordingly, water is prevented from ingress through opening 30.

Figure 6:
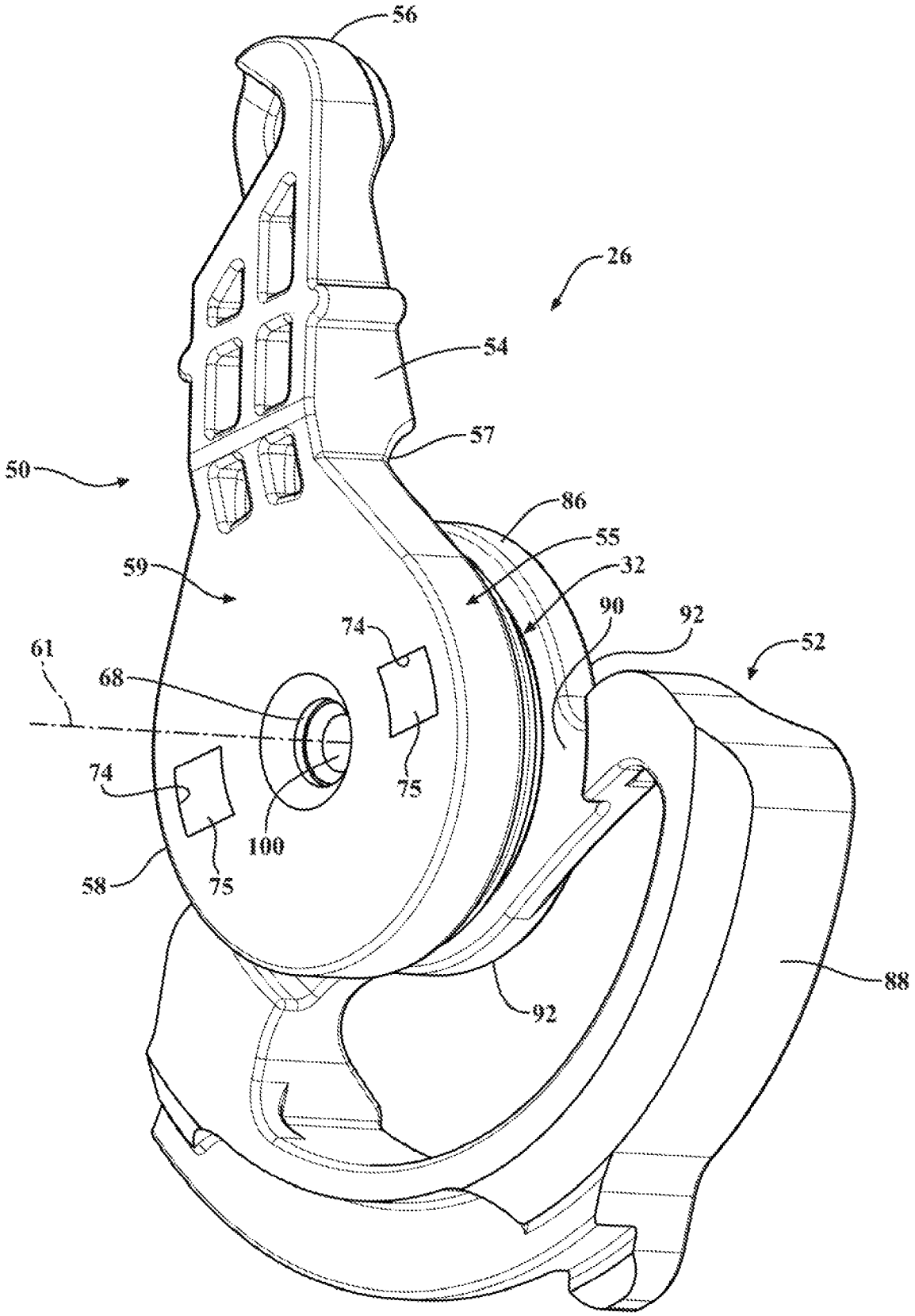
FIG. 6 is a top perspective view of the outside lock lever of FIG. 3.
Figure 7:
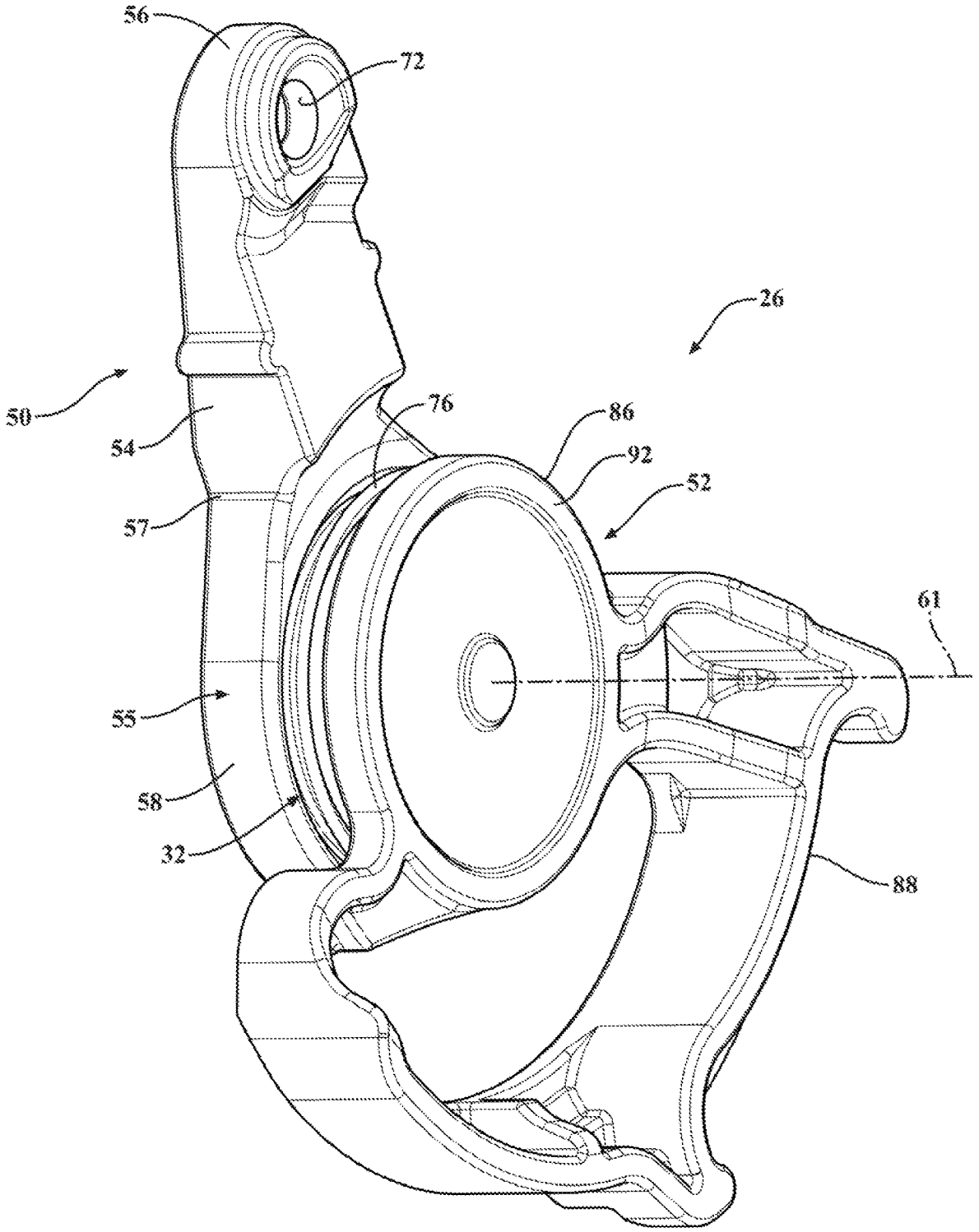
FIG. 7 is a bottom perspective view of the outside lock lever of FIG. 3.
Figure 10:
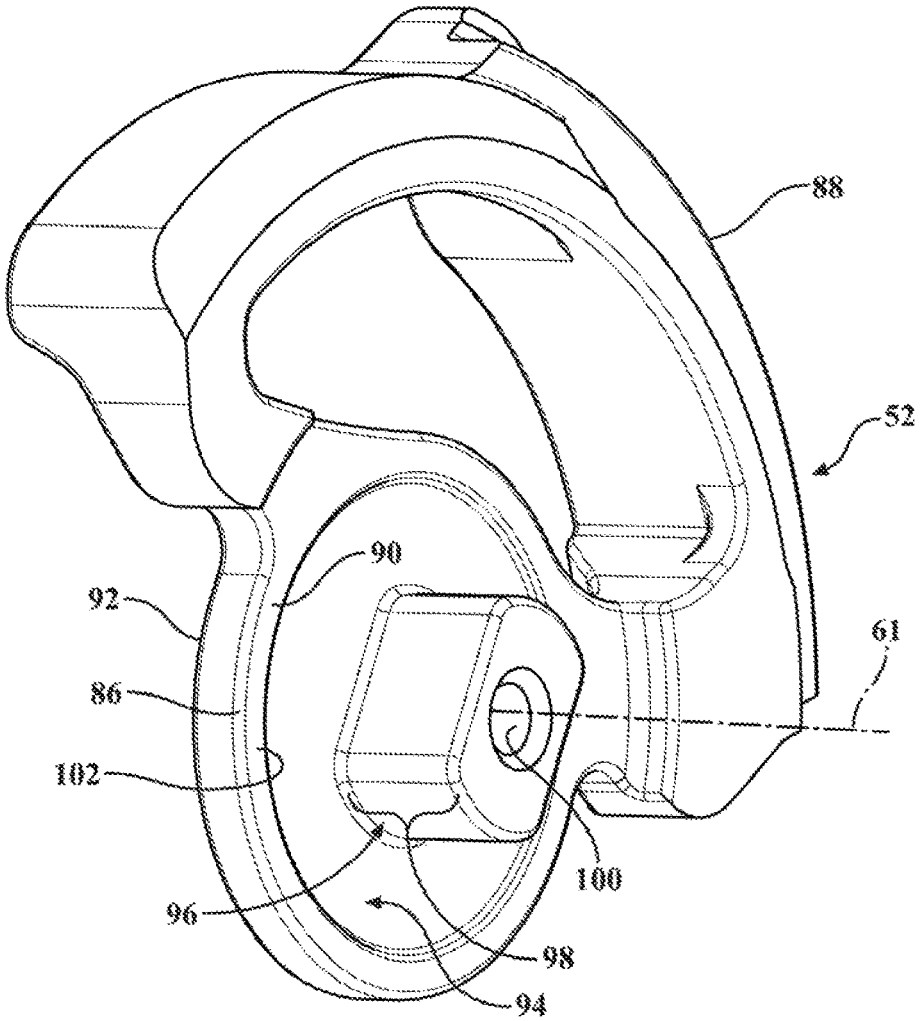
FIG. 10 is a perspective view of a second portion of the outside lock lever of FIG. 6.

The second member 52, as best illustrated in FIGS. 6-7 and 10, includes an annular disc portion 86 extending about axis 61 and a gear interface portion 88 extending radially outwardly from disc portion 86. Gear interface portion 88 is configured to operably interact with lock/unlock gear 44 to selectively effectuate moving latch 20, with respect to outside door handle 17, between its locked and unlocked states in response to actuation of key cylinder 24. Annular disc portion 86 has an outer or upper surface 90 facing first member 50 and an inner or lower surface 92 opposite upper surface 90. Upper surface 90 has a recessed, toroid-shaped counterbore, also referred to as trough 94, extending about axis 61. As best shown in FIG. 5, trough 94 is sized for receipt of the free end 82 of boss 60 therein, with free end 82 shown being disposed in close, line-to-line or nearly line-to-line proximity with upper surface 90. The second member 52 has male stub, also referred to as protrusion 96, extending upwardly and outwardly from trough 94 along axis 61 for receipt in bore 64 of boss 60. The male protrusion 96 has a non-circular end region 98 configured for close mating receipt in non-circular pocket 66 of bore 64, wherein end region 98 is shown having a mating, corresponding rectangular shape sized for close fit (e.g. line-to-line) within pocket 66, thereby preventing relative rotation between first and second members 50, 52 upon their being assembled to one another. To facilitate fixation of second member 52 to first member 50, protrusion 96 has a passage 100 extending along axis 61 for threaded receipt of fastener 70. Passage 100 is illustrated as being a blind passage and not a through passage, thereby further preventing ingress of water past outside lock lever 26 into internal cavity 27. Passage 100 can be threaded or sized for self-tapping of fastener 70 therein. An annular outer periphery 102 of planar upper surface 90 extending about trough 94 is configured for low frictional engagement with inner surface 79 of housing 23.

In assembly, boss 60 of first member 50, with seal member 32 fixed thereto, can be disposed through opening 30 in housing 23 wherein seal lip 76 is brought into sealed engagement and caused to flare radially outwardly against outer surface 77 of housing 23. Male protrusion 96 is oriented for receipt in bore 64 such that end region 98 is received for mating fit within pocket 66. Then, fastener 70 is disposed into through opening 68 and threaded into passage 100, thereby fixing first and second members 50, 52 to one another. Upon fixing first and second members 50, 52 to one another, seal lip 76 is maintained in sealed abutment with housing outer surface 77; cylindrical outer surface 62 of boss 60 is brought into close relation with opening 30. Further, outer periphery 102 of disc portion 86 is brought into engagement with housing inner surface 79 for low friction pivoting movement there against. It is to be recognized that the axially extending height of male protrusion 96 is provided to allow for receipt within the axially extending depth of bore 64 to allow the aforementioned engagements between respective surfaces. Accordingly, the male protrusion 96 can be provided having a height equal to or slightly less than the depth of bore 64, as will be understood upon viewing the disclosure herein. Upon completion of assembly of outside lock lever 26 to housing 23, pivotal movement of outside lock lever 26 relative to housing 23 is freely permitted in response to selective actuation of key cylinder 24, while the ingress of water past outside lock lever 26 into cavity 27 of housing 23 is prevented.

In FIGS. 11-14, a latch assembly, referred to hereafter as latch 120, constructed in accordance with another aspect of the disclosure is shown, wherein the same reference numeral as used above, offset by a factor of 100, are used to identify like features. New features are identified with 200 series reference numerals.

Latch 120 includes the same internal components 31 discussed above, and thus, discussion hereafter is focused mainly on the differences related to an actuator lever, i.e. an outside lock lever 126, configured in operable communication with key cylinder 24. Outside lock lever, referred to hereafter as lock lever 126, rather than being constructed as two-piece assembly including first and second members as discussed above for lock lever 26, is shown in accordance with another aspect of the disclosure as being a one-piece, monolithic construction. Lock lever 126 has an elongate arm portion 154, also referred to as arm, extending lengthwise between opposite ends 156, 157. Arm 154 extends through an elongate (generally rectangular (as viewed in 2-D plan view) opening 130 (FIGS. 11A, 12 and 14) of a housing 123 for pivoting movement within opening 130 along a direction of arrow A via pivotal attachment to an internal axle or stub of housing 123, also referred to as hub 210, within internal cavity 127 of housing 123. Latch lever 126 includes a gear interface portion 188 formed as a monolithic piece of material therewith, wherein gear interface portion 188 extends from end 157 and functions the same as gear interface portion 88 discussed above. To facilitate the inhibition of water ingress through the opening 130 and into the cavity 127 containing internal latch components, the latch 120 includes a seal member 132 disposed about a portion of the lock lever 126 to form a water-tight seal between the housing 123 and the lock lever 126, thereby preventing the passage and ingress of water through the opening 130. Accordingly, the latch assembly 120 is able to function as intended, for an extended useful life, without concern of malfunction resulting from phenomenon related to the ingress of water.

Figure 11:
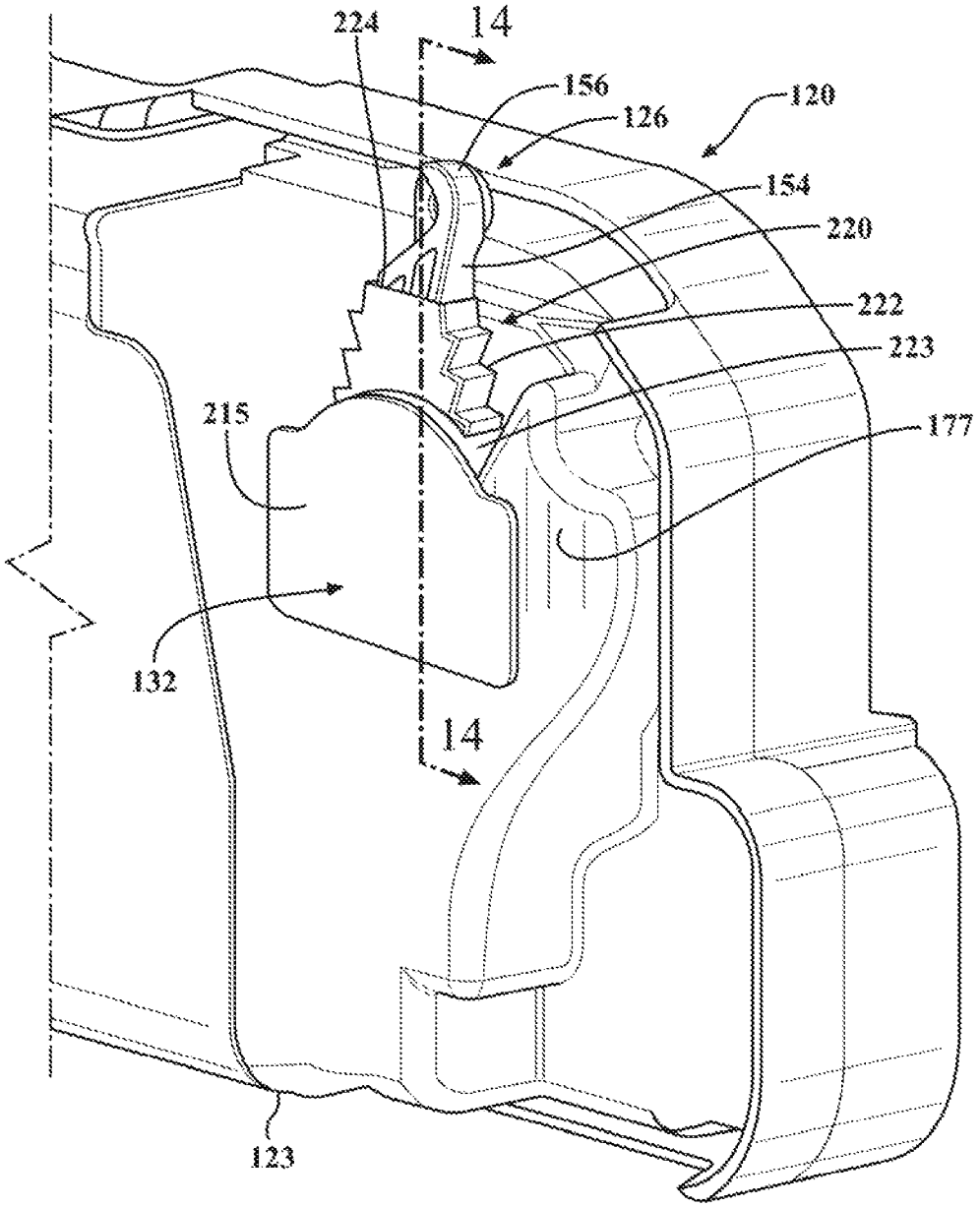
FIG. 11 is a perspective view of a portion of a latch assembly constructed in accordance with another aspect of the disclosure.
Figure 11A:
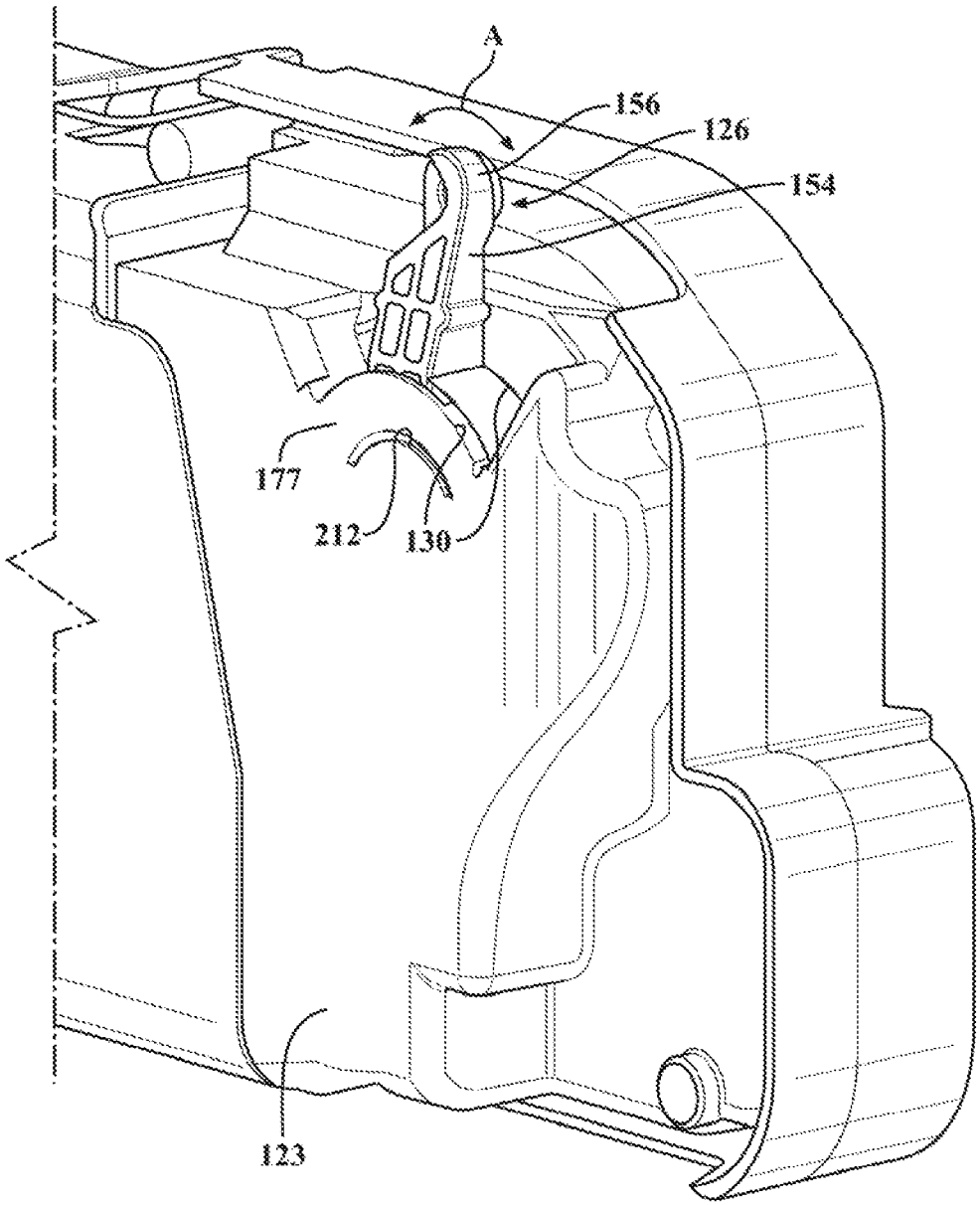
FIG. 11A is a perspective view showing a portion of the latch assembly of FIG. 11 prior to assembly of a seal member about an outside lock lever thereof.
Figure 12:
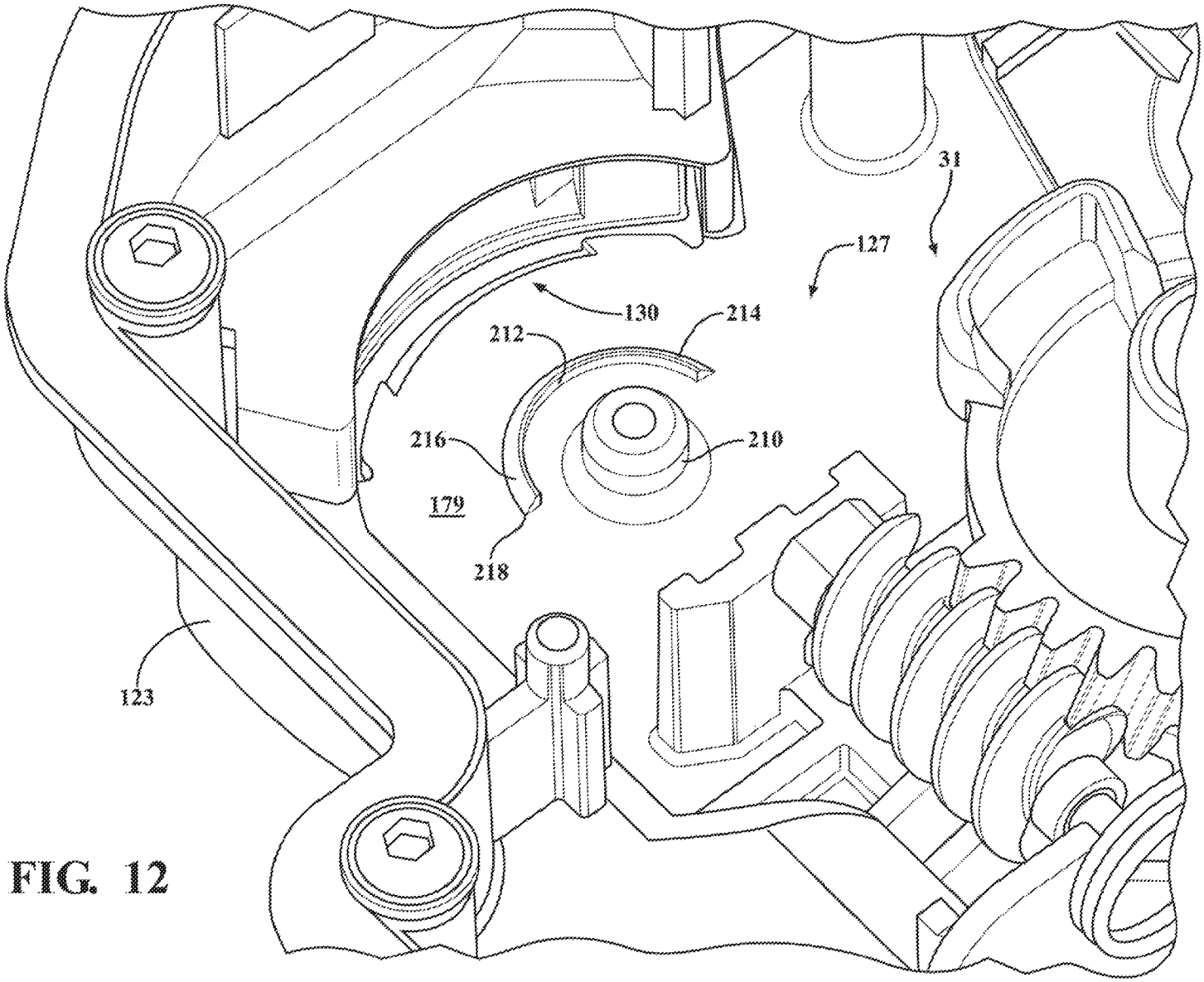
FIG. 12 is an inside perspective view of a portion of a housing of the latch assembly of FIG. 11 shown with the seal member assembled thereto and with the outside lock lever removed for clarity purposes of illustrating the seal member.
Figure 13:
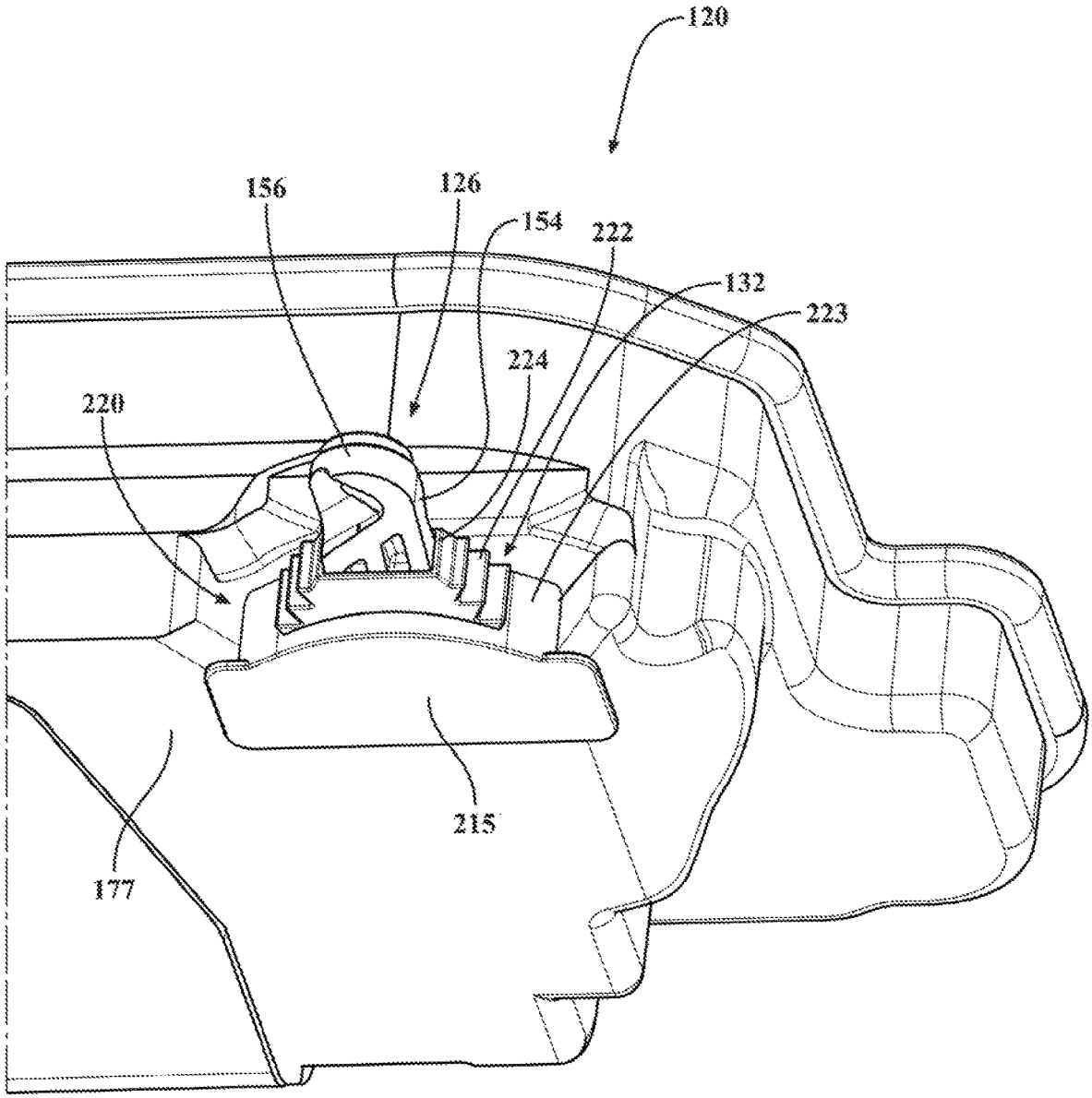
FIG. 13 is a top perspective view of a portion of the latch assembly of FIG. 12 illustrating the seal member thereof.

Seal member 132 is formed of any desired resilient, elastomeric material, such as from various types of rubber, such as discussed above for seal member 32. Seal member 132 is configured for fixed attached to housing 123 to close off opening 130 against the passage of water therethrough. Seal member 132 is provided not only to close of opening 130 against the passage of water, but also to allow for free laterally pivoting movement of arm 154 in direction A (FIG. 11A) along the length of opening 130 during actuation of key cylinder 24. To facilitate fixation of seal member 132 to housing 123, housing 123 is provided with a fastener opening 212 configured for receipt of a fastening member 214 of seal member 132 therein. A non-limiting embodiment of fastener opening 212 is best illustrated in FIGS. 11A and 12 as being arcuate, such as generally semi-circular or sickle-shaped for receipt of a similarly shaped fastening member 214 fixed to seal member 132. Fastening member 214 is shown as being formed as a monolithic piece of material with a body of seal member 132, such as in a molding process, e.g. injection molding process, by way of example and without limitation. Fastening member 214 is shown extending from a generally planar wall 215 of seal member 132 to a free end having a barb, also referred to a catch 216 (FIGS. 12 and 14), formed thereon. Catch 216 has a projection or lip 218 that overhangs and confronts a portion of an inner surface 179 of housing 123, such that upon elastically deforming and disposing catch 216 through the fastener opening 212, catch 216 elastically retains its non-deformed shape and prevents unwanted removal of seal member 132 from housing 123, thereby fixing seal member 132 to housing 123.

Figure 14:
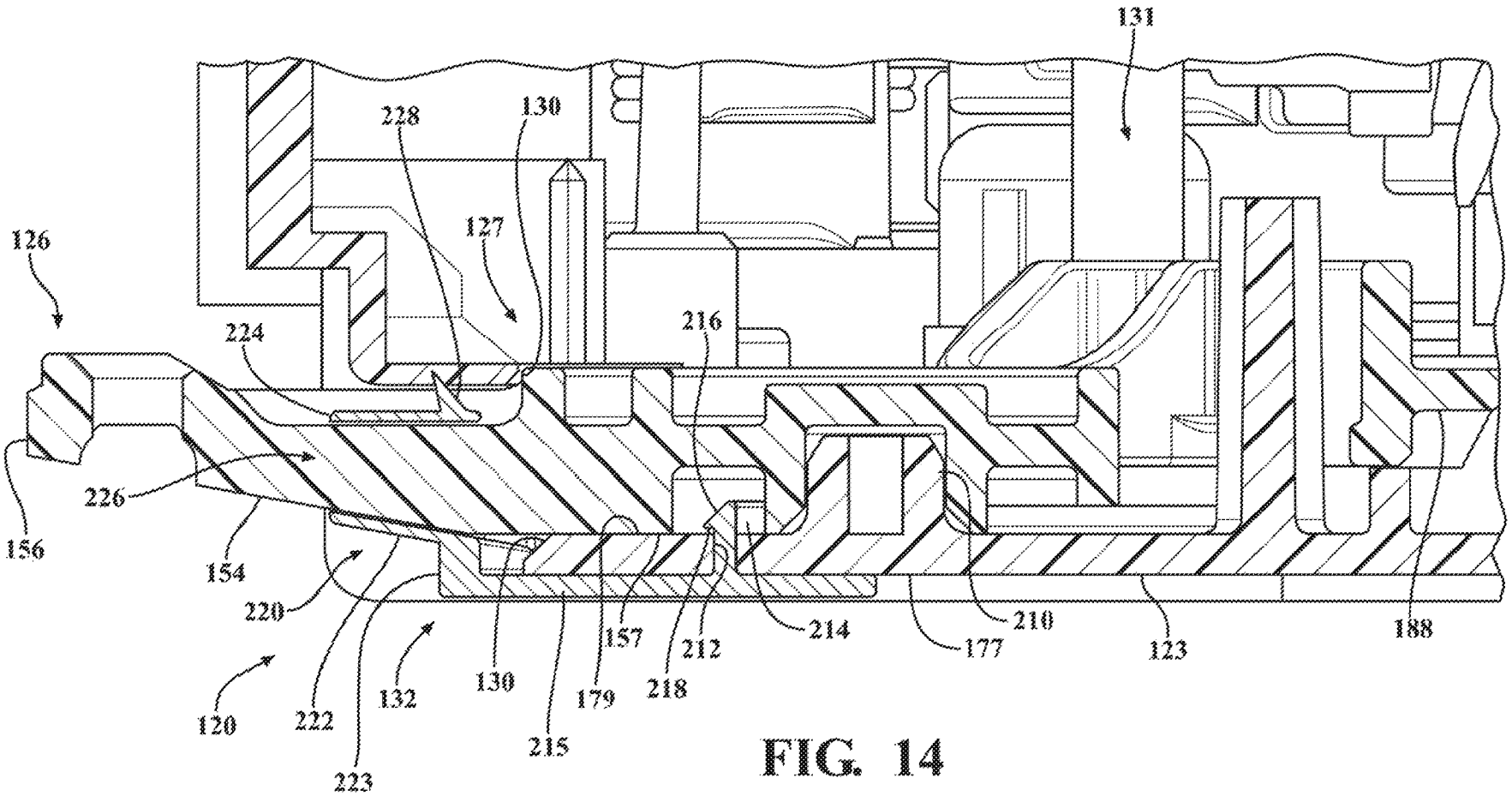
FIG. 14 is a cross-sectional view taken generally along the line 14-14 of FIG. 11.
Figure 15:
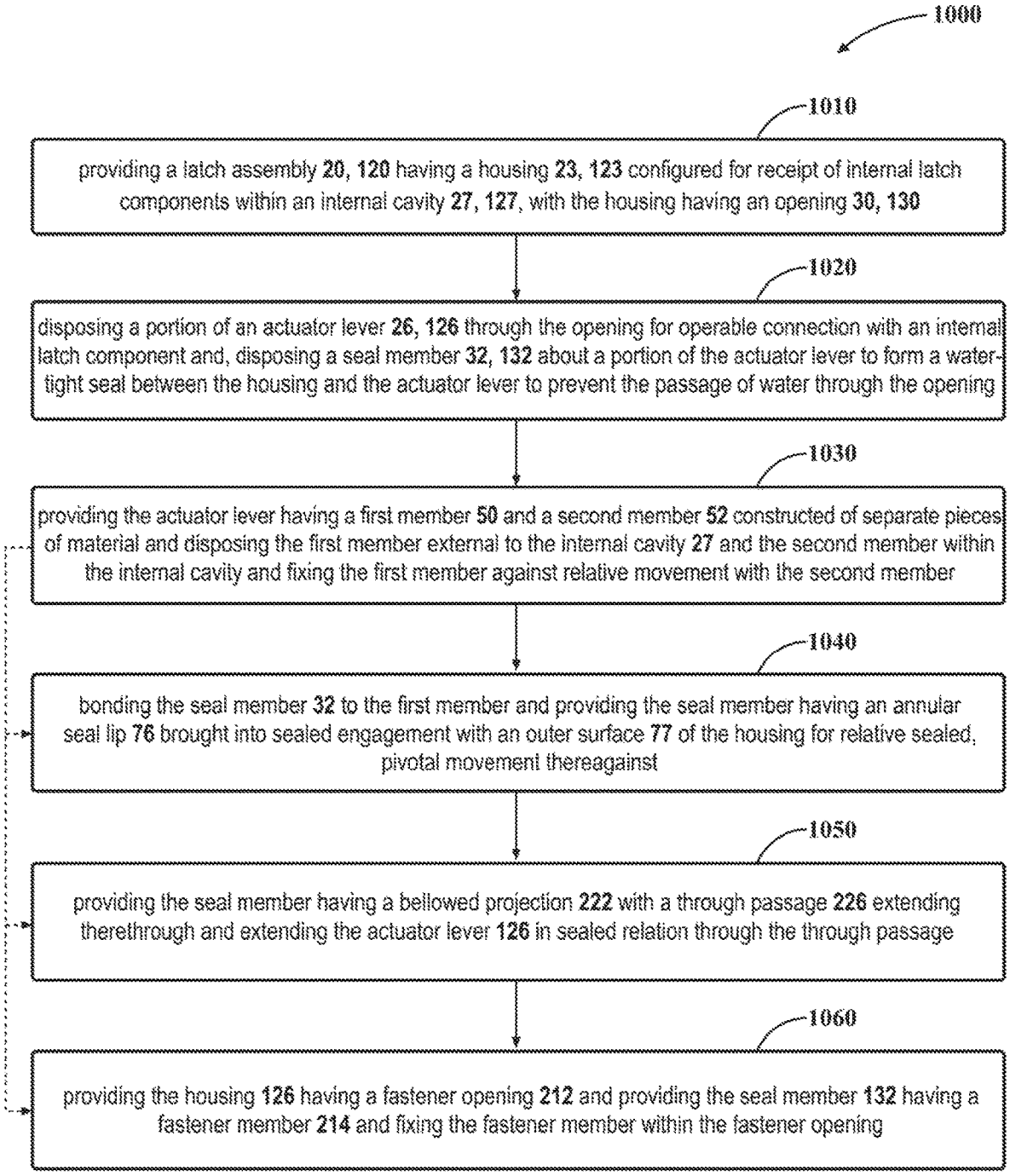
FIG. 15 is a flow diagram illustrating a method of preventing ingress of water into an internal cavity of a latch assembly of a vehicle closure panel between an actuator lever and an opening in a housing of the latch assembly.

Seal member 132 includes generally planar wall 215 configured to lie substantially flush along an outer surface 177 of housing 123, though non-planar contours are contemplated herein, as may be desired depending on the contour of the housing outer surface 177, and a water shield portion 220 configured receipt about arm 154 to close off opening 130. Water shield portion 220 is shown as extending laterally from wall 215 to provide a bellowed (accordion like folds) projection 222 extending upwardly from a base wall 223 to a peak 224 having a through passage 226 (FIG. 14). Base wall 223 is shown extending generally transversely from wall 215, while projection 222 extends generally transversely from base wall 223. The bellowed projection 222 provides for the free pivoting movement of arm 154 in use via freely flexible movement of bellowed projection 222. The through passage 226 is sized for a close interference receipt of arm 154 therethrough, while forming a sealed, water-tight fit about arm 154 adjacent and/or at the peak 224. To facilitate closing off opening 130 against the passage of water, a seal lip 228 (FIG. 14) can be formed to project outwardly from (away from wall 215) and extend along a portion or the entirety of an outer surface of base wall 223 for sealed engagement against the outer surface 177 of housing 123 above opening 130 of housing 123. The seal lip 228 can be configured as desired to form a water-tight seal along the entirety of the housing outer surface 177 immediately adjacent the opening 130.

In assembly, the entirety of the latch 120 can be assembled prior to fixation of seal member 132 thereto. Then, with the latch 120 assembled, the bellowed projection 222 can be disposed about arm 154, wherein arm 154 can slide through the through passage 226 into sealed interference engagement with peak 224. Accordingly, it is to be recognized that the periphery of the through passage 226 at peak 224 is preferably slightly smaller in dimension than the outer periphery of a corresponding region of arm 154 upon full assembly of seal member 132. Upon sliding seal member 132 into position about arm 154, seal lip 228 is automatically brought into seal abutment with outer surface 177 of housing 123, and fastener member 214 can be pressed and elastically deformed through fastener opening 212 of housing 123, whereupon lip 218 can be elastically returned and brought into its retaining catch position against the inner surface 179 of housing 123. Accordingly, assembly of seal member 132 is economical and does not require secondary fastening mechanisms.

In accordance with a further aspect of the disclosure, a method 1000 of preventing ingress of water into an internal cavity of a latch assembly of a vehicle closure panel between an actuator lever and an opening in a housing of the latch assembly is provided. The method 1000 includes a step 1010 of providing a latch assembly 20, 120 having a housing 23, 123 configured for receipt of internal latch components within an internal cavity 27, 127, with the housing 23, 123 having an opening 30, 130. A further step 1020 includes disposing a portion of the actuator lever 26, 126 through the opening 30, 130 for operable connection with an internal latch component and, disposing a seal member 32, 132 about a portion of the actuator lever 26, 126 to form a water-tight seal between the housing 23, 123 and the actuator lever 26, 126 to prevent the passage of water through the opening 30, 130.

In accordance with a further aspect of the disclosure, the method 1000 can further include a step 1030 of providing the actuator lever having a first member 50 and a second member 52 constructed of separate pieces of material and disposing the first member 50 external to the internal cavity 27 and the second member 52 within the internal cavity 27 and fixing the first member 50 against relative movement with the second member 52.

In accordance with a further aspect of the disclosure, the method can further include a step 1040 of bonding the seal member 32 to the first member 50 and providing the seal member 32 having an annular seal lip 76 brought into sealed engagement with an outer surface 77 of the housing 23 for relative sealed, pivotal movement thereagainst.

In accordance with a further aspect of the disclosure, the method can further include a step 1050 of providing the seal member having a bellowed projection 222 with a through passage 226 extending therethrough and extending the actuator lever 126 in sealed relation through the through passage 226.

In accordance with a further aspect of the disclosure, the method can further include a step 1060 of providing the housing 123 having a fastener opening 212 and providing the seal member 132 having a fastener member 214 and fixing the fastener member 214 within the fastener opening 212.

While the above description constitutes a plurality of embodiments of the present invention, it will be appreciated that the present invention is subject to further modification and change without departing from the fair interpretation and intended meaning of the accompanying claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a vehicle closure panel, the latch assembly comprising:

a housing having an outer surface, an inner surface and an opening extending through said outer surface and said inner surface, said inner surface facing an internal cavity of the housing, the internal cavity configured for receipt of internal latch components;

a cover attached to said housing to enclose at least a portion of said internal cavity;

an actuator lever received in said opening and configured for operable connection to one of the internal latch components for actuating one of the internal latch components; and a seal member disposed about a portion of said actuator lever to form a water-tight seal between said housing and said actuator lever to prevent the passage of water through said opening;

wherein said seal member is disposed between said actuator lever and said outer surface of said housing;

wherein said seal member has a projection with a through passage extending therethrough, said actuator lever extending through said through passage;

wherein said housing has a fastener opening and said seal member has a fastener member fixed with said fastener opening.

2. The latch assembly of claim 1, wherein said seal member is fixed against relative movement with said actuator lever.

3. The latch assembly of claim 2, wherein said seal member is bonded with said actuator lever.

4. The latch assembly of claim 2, wherein seal member and said actuator lever are configured to pivot relative to said housing.

5. The latch assembly of claim 2, wherein said actuator lever has a first member disposed external to said internal cavity and a second member disposed within said internal cavity, said first member and said second member being constructed of separate pieces of material, said first member being fixed against relative movement with said second member.

6. The latch assembly of claim 5, wherein said first member has one of a non-circular male protrusion and a non-circular female pocket and the second member has the other of said non-circular male protrusion and said non-circular female pocket, said non-circular male protrusion being configured for mating receipt in said non-circular female pocket to prevent relative rotation between said first member and said second member.

7. The latch assembly of claim 5, wherein said seal member is bonded to said first member.

8. The latch assembly of claim 7, wherein said seal member has an annular seal lip brought into seal engagement with said outer surface for relative pivotal movement thereagainst.

9. A latch assembly for a vehicle closure panel, the latch assembly comprising:

a housing having an outer surface, an inner surface and an opening extending through said outer surface and said inner surface, said inner surface facing an internal cavity of the housing, the internal cavity configured for receipt of internal latch components;

a cover attached to said housing to enclose at least a portion of said internal cavity;

an actuator lever received in said opening and configured for operable connection to one of the internal latch components for actuating one of the internal latch components; and a seal member disposed about a portion of said actuator lever to form a water-tight seal between said housing and said actuator lever to prevent the passage of water through said opening;

wherein said seal member is disposed between said actuator lever and said outer surface of said housing;

wherein said seal member is fixed against relative movement with said actuator lever;

wherein said actuator lever has a first member disposed external to said internal cavity and a second member disposed within said internal cavity, said first member and said second member being constructed of separate pieces of material, said first member being fixed against relative movement with said second member;

wherein said seal member is bonded to said first member;

wherein said seal member has an annular seal lip brought into seal engagement with said outer surface for relative pivotal movement thereagainst;

wherein said housing has a fastener opening and said seal member has a fastener member fixed within said fastener opening.

10. The latch assembly of claim 8, wherein said second member is coupled with a lock/unlock gear within said internal cavity.

11. The latch assembly of claim 1, wherein said seal member has a seal lip in sealed engagement with said outer surface of said housing.

12. The latch assembly of claim 1, wherein said actuator lever is an outside lock lever.

13. The latch assembly of claim 1, wherein said projection is a bellowed projection.

14. The latch assembly of claim 1, wherein said seal member has a base wall from which said projection extends and a seal lip extending along at least a portion of said base wall for sealed engagement with said outer surface of said housing.

15. A method of preventing ingress of water into an internal cavity of a latch assembly of a vehicle closure panel between an actuator lever and an opening in a housing of the latch assembly, the method comprising the steps of:

disposing a portion of the actuator lever through the opening in the housing, the actuator lever disposed for operable connection with an internal latch component; and disposing a seal member about a portion of the actuator lever to form a water-tight seal between the housing and the actuator lever to prevent the passage of water through the opening;

wherein said seal member is disposed between said actuator lever and an outer surface of said housing;

providing the seal member having a bellowed projection with a through passage extending therethrough and extending the actuator lever in sealed relation through the through passage; and/or further including providing the housing having a fastener opening and providing the seal member having a fastener member and fixing the fastener member within the fastener opening.

16. The method of claim 15, further including providing the actuator lever having a first member and a second member constructed of separate pieces of material and disposing the first member external to the internal cavity and the second member within the internal cavity and fixing the first member against relative movement with the second member.

17. The method of claim 16, further including bonding the seal member to the first member and providing the seal member having an annular seal lip brought into sealed engagement with an outer surface of the housing for relative sealed, pivotal movement thereagainst.

18. A vehicle closure panel comprising:

a latch assembly for a vehicle closure panel, the latch assembly comprising:

a housing having an outer surface, an inner surface and an opening extending through said outer surface and said inner surface, said inner surface facing an internal cavity of the housing configured for receipt of internal latch components;

a cover attached to said housing to enclose at least a portion of said internal cavity;

an actuator lever received in said opening and configured for operable connection to one of the internal latch components for actuating one of the internal latch components; and a seal member disposed about a portion of said actuator lever to form a water-tight seal between said housing and said actuator lever to prevent the passage of water through said opening;

wherein said seal member is disposed between said actuator lever and said outer surface of said housing;

wherein said seal member has a projection with a through passage extending therethrough, said actuator lever extending through said through passage;

wherein said housing has a fastener opening and said seal member has a fastener member fixed with said fastener opening.

* * * * *